US011988005B2

(12) United States Patent
Conrad, Jr.

(10) Patent No.: US 11,988,005 B2
(45) Date of Patent: May 21, 2024

(54) CRYPT SYSTEM

(71) Applicant: Raymond Conrad, Jr., Heislerville, NJ (US)

(72) Inventor: Raymond Conrad, Jr., Heislerville, NJ (US)

( * ) Notice: Subject to any disclaimer, the term of this patent is extended or adjusted under 35 U.S.C. 154(b) by 113 days.

(21) Appl. No.: 17/375,385

(22) Filed: Jul. 14, 2021

(65) Prior Publication Data

US 2022/0018150 A1 Jan. 20, 2022

Related U.S. Application Data

(60) Provisional application No. 62/705,746, filed on Jul. 14, 2020.

(51) Int. Cl.
*E04H 13/00* (2006.01)

(52) U.S. Cl.
CPC ..... *E04H 13/006* (2013.01)

(58) Field of Classification Search
CPC .... E04H 13/006; E04H 13/005; E04H 13/008
USPC ..... 52/134, 136
See application file for complete search history.

(56) References Cited

U.S. PATENT DOCUMENTS 3,938,287 A * 2/1976 Gauchard ..... E04H 13/005 27/11
3,986,308 A * 10/1976 Jones ..... E04H 13/006 52/745.03
5,217,622 A * 6/1993 Flores ..... E04H 13/005 55/315
5,408,787 A * 4/1995 Barnett ..... E04H 13/00 52/134
5,894,699 A * 4/1999 Fulton ..... E04H 13/006 52/134
6,105,315 A * 8/2000 Stoecklein ..... E04H 13/006 52/439
9,249,598 B2 * 2/2016 Bridgeman ..... E04H 13/006
9,458,643 B2 10/2016 Young et al.
11,124,986 B1 * 9/2021 Buehrer ..... E04H 13/006
2010/0275529 A1 * 11/2010 Bridgemen ..... E04H 13/006 52/134
2011/0154748 A1 * 6/2011 Young ..... E04H 13/006 52/745.01

(Continued)

FOREIGN PATENT DOCUMENTS

CA 2236289 A1 * 2/1999
ES 1075910 U * 12/2011 ..... E04H 13/006

*Primary Examiner* — William L Miller
(74) *Attorney, Agent, or Firm* — Buchanan Ingersoll & Rooney PC

(57) ABSTRACT

Embodiments relate to a crypt system having a frame used as a skeleton structure upon which a façade is secured. The frame includes vertical and horizontal supports, each equipped with a mechanical interconnecting arrangement that allows the frame to be assembled easily and with close tolerances. The interconnecting arrangement also provides the structural stability and integrity desired for a mausoleum or columbarium, even when the system is free-standing. Each horizontal support has a fluid channel that collects fluid (e.g., gas and/or liquid) and directs it to the vertical support in connection with the horizontal support. Each vertical support has a fluid channel to direct the gas up to a conduit that leads to outside the building that houses the crypt system. The vertical fluid channel also directs liquid down to a drain that captures the liquid.

17 Claims, 11 Drawing Sheets

(56) References Cited

U.S. PATENT DOCUMENTS

2015/0308141 A1* 10/2015 Ugartechea Berlanga ..... E04H 13/008 52/135
2019/0010724 A1* 1/2019 Jaeger ..... E04B 7/022

* cited by examiner

CRYPT SYSTEM

CROSS-REFERENCE TO RELATED APPLICATIONS

This patent application claims the benefit of and priority to U.S. Provisional Patent Application No. 62/705,746, filed on Jul. 14, 2020, the entire contents of which are incorporated herein by reference in their entirety.

FIELD OF THE INVENTION

Embodiments relate to a crypt system having a frame used as a skeleton structure upon which a façade (e.g., stone, marble, etc.) is secured. The frame includes a mechanical interconnecting arrangement, allowing it to be assembled easily and with close tolerances. The interconnecting arrangement also provides the structural stability and integrity desired for a mausoleum or columbarium, even when the system is free-standing. The frame further includes a built-in ventilation/drainage network to direct gases and fluids to desired locations.

BACKGROUND OF THE INVENTION

Conventional crypt systems include a framework upon which a façade is secured, but these systems are constructed on-site, thereby reducing efficiency and precluding the ability to construct the system with close tolerances. These systems also require load-bearing structures to be attached to or built within, thereby preventing the ability to build a crypt system in an open area (e.g., in a hallway, basement, etc.) or in a non-load-bearing structure (e.g., within a non-load-bearing wall). In addition, conventional systems do not offer any type of effective ventilation system to vent gases (gases emitted from the remains) to outside the building housing the crypt or a drainage system to prevent liquids (liquids from the remains) from running down the façade of the crypt system.

The present disclosure is directed toward overcoming one or more of the above-mentioned problems, though not necessarily limited to embodiments that do.

SUMMARY OF THE INVENTION

Embodiments relate to a crypt system having a frame used as a skeleton structure upon which a façade (e.g., stone, marble, etc.) is secured. The frame includes vertical and horizontal supports, each equipped with a mechanical interconnecting arrangement that allows the frame to be assembled easily and with close tolerances. The interconnecting arrangement also provides the structural stability and integrity desired for a mausoleum or columbarium, even when the system is free-standing. It is contemplated for sections of the frame to be fabricated and assembled in an assembly shop or manufacturing shop. The sections can then be transported to the site for assembly into the frame or skeleton structure. Fabricating and assembling the sections in the shop (as opposed to doing so on-site) allows for the closer tolerances when forming the frame. Each horizontal support has a fluid channel that collects fluid (e.g., gas and/or liquid) and directs it to the vertical support in connection with the horizontal support. Each vertical support has a fluid channel to direct the gas up to a conduit that leads to outside the building that houses the crypt system. The vertical fluid channel also directs liquid down to a drain that captures the liquid.

In an exemplary embodiment, a crypt system framework includes: a frame comprising a plurality of vertical supports and a plurality of horizontal supports; at least one horizontal support having a horizontal support fluid channel, and at least one vertical support having a vertical support fluid channel. The at least one horizontal support is connected to the at least one vertical support so that the horizontal support fluid channel is in fluid communication with the vertical support fluid channel.

In some embodiments, the frame consists of stainless steel.

In some embodiments, each vertical support is a square tube beam or a rectangular tube beam having a longitudinal axis, a first vertical support end, a second vertical support end, an interior surface, an exterior surface, and a slot that is formed in a side of the vertical support that runs along the longitudinal axis from the first vertical support end to the second vertical support end. Each horizontal support is a square tube beam or a rectangular tube beam having a longitudinal axis, a first horizontal support end, a second horizontal support end, an interior surface, an exterior surface, and a slot that is formed in a side of the horizontal support that runs along the longitudinal axis from the first horizontal support end to the second horizontal support end.

In some embodiments, the first vertical support end of each vertical support is placed into fluid communication with a conduit that leads to a drain. The second vertical support end of each vertical support is placed into fluid communication with a conduit that leads to a ventilation system.

In some embodiments, the system includes a plurality of truing saddles, each truing saddle connected to an individual vertical support to hold the vertical support in an erect and up-right orientation.

In some embodiments, the at least one horizontal support is connected to the at least one vertical support so that the at least one horizontal support extends from the at least one vertical support so as to form an 85°-89° angle with respect to the at least one vertical support.

In some embodiments, the frame has an interconnecting arrangement for attaching the at least one horizontal support to the at least one vertical support, the interconnecting arrangement including prongs of the at least one horizontal support extending through slits formed in the at least one vertical support.

In some embodiments, the system includes a flap formed in a side of the horizontal support that is opposite the slot, the flap being deformable or bendable to create an opening that leads into the vertical support fluid channel.

In some embodiments, each horizontal support is a square tube beam or a rectangular tube beam having a longitudinal axis, a first horizontal support end, a second horizontal support end, an interior surface, and an exterior surface, wherein the exterior surface includes a first side, a second side, a third side, and a fourth side, wherein a slot is formed in the first side of the horizontal support that runs along the longitudinal axis from the first horizontal support end to the second horizontal support end. Each vertical support is a square tube beam or a rectangular tube beam having a longitudinal axis, a first vertical support end, a second vertical support end, an interior surface, and an exterior surface, wherein the exterior surface includes a first side, a second side, a third side, and a fourth side, wherein a slot is formed in the first side of the vertical support that runs along the longitudinal axis from the first vertical support end to the second vertical support end.

In some embodiments, the system includes a plurality of floor support beams, wherein each floor support beam is a U-shaped channel structure with a floor support beam first end having a J-shaped interconnect that extends from the first end of the floor support beam in a cantilever manner, and a floor support beam second end having a J-shaped interconnect that extends from the second end of the floor support beam in a cantilever manner.

In some embodiments, each floor support beam is abutted against a horizontal support so that the J-shaped interconnect rests on top of the first side of the horizontal support and also extends into the horizontal support fluid channel.

In an exemplary embodiment, a crypt system includes a frame. The frame includes a plurality of vertical supports and a plurality of horizontal supports. Each vertical support is a square tube beam or a rectangular tube beam having a longitudinal axis, a first vertical support end, a second vertical support end, an interior surface, an exterior surface, and a slot that is formed in a side of the vertical support that runs along the longitudinal axis from the first vertical support end to the second vertical support end, wherein the interior surface forms a vertical support fluid channel. Each horizontal support is a square tube beam or a rectangular tube beam having a longitudinal axis, a first horizontal support end, a second horizontal support end, an interior surface, an exterior surface, and a slot that is formed in a side of the horizontal support that runs along the longitudinal axis from the first horizontal support end to the second horizontal support end, wherein the interior surface forms a horizontal support fluid channel. Each vertical support has a plurality of horizontal supports connected thereto so that the horizontal support fluid channel of each is in fluid communication with the vertical support fluid channel. The plurality of vertical supports and the plurality of horizontal supports are arranged to generate a plurality of crypt spaces. The system has a plurality of wall panels, each wall panel forming a sidewall for each crypt space. The system has a plurality of floor panels, each floor panel forming a floor for each crypt space. A façade attached to an exterior of the frame.

In some embodiments, the frame, the plurality of wall panels, and the plurality of floor panels consist of stainless steel.

In some embodiments, the first vertical support end of each vertical support is placed into fluid communication with a conduit that leads to a drain, and liquid generated within the plurality of crypt spaces is directed through a horizontal support fluid channel to a vertical support fluid channel and to the drain. The second vertical support end of each vertical support is placed into fluid communication with a conduit that leads to a ventilation system, and gas generated within the plurality of crypt spaces is directed through a horizontal support fluid channel to a vertical support fluid channel and to the ventilation system.

In some embodiments, at least one horizontal support is connected to its respective vertical support so that the at least one horizontal support extends from the vertical support so as to form a 85°-89° angle with respect to the vertical support, thereby allowing gravity to force the liquid or gas to travel from the horizontal support fluid channel to the vertical support fluid channel.

In some embodiments, each first horizontal support end has two prongs. Each second horizontal support end has two prongs. Each vertical support has a pair of slots configured to receive the two prongs of the first or second horizontal support end.

In some embodiments, each wall panel is a planar sheet having a top end that is L shaped and a bottom end that is dog-leg shaped.

In some embodiments, each wall panel rests upon a horizontal support so that it partially extends into the horizontal fluid channel through the slot of the horizontal support.

In an exemplary embodiment, a method of assembling a crypt system framework involves: connecting at least one horizontal support to at least one vertical support to generate a frame section; forming a plurality of frame sections; transporting the plurality of frame sections to a crypt site; and connecting the plurality of frame sections to form a frame.

In some embodiments, the method involves forming a slot in at least one horizontal support to serve as a horizontal support fluid channel. The method involves forming a slot in at least one vertical support to serve as a vertical support fluid channel.

Further features, aspects, objects, advantages, and possible applications of the present invention will become apparent from a study of the exemplary embodiments and examples described below, in combination with the Figures, and the appended claims.

BRIEF DESCRIPTION OF THE DRAWINGS

The above and other objects, aspects, features, advantages and possible applications of the present invention will be more apparent from the following more particular description thereof, presented in conjunction with the following drawings. Like reference numbers used in the drawings may identify like components.

DETAILED DESCRIPTION OF THE INVENTION

The following description is of exemplary embodiments that are presently contemplated for carrying out the present invention. This description is not to be taken in a limiting sense, but is made merely for the purpose of describing the general principles and features of the present invention. The scope of the present invention is not limited by this description.

Figure 1:
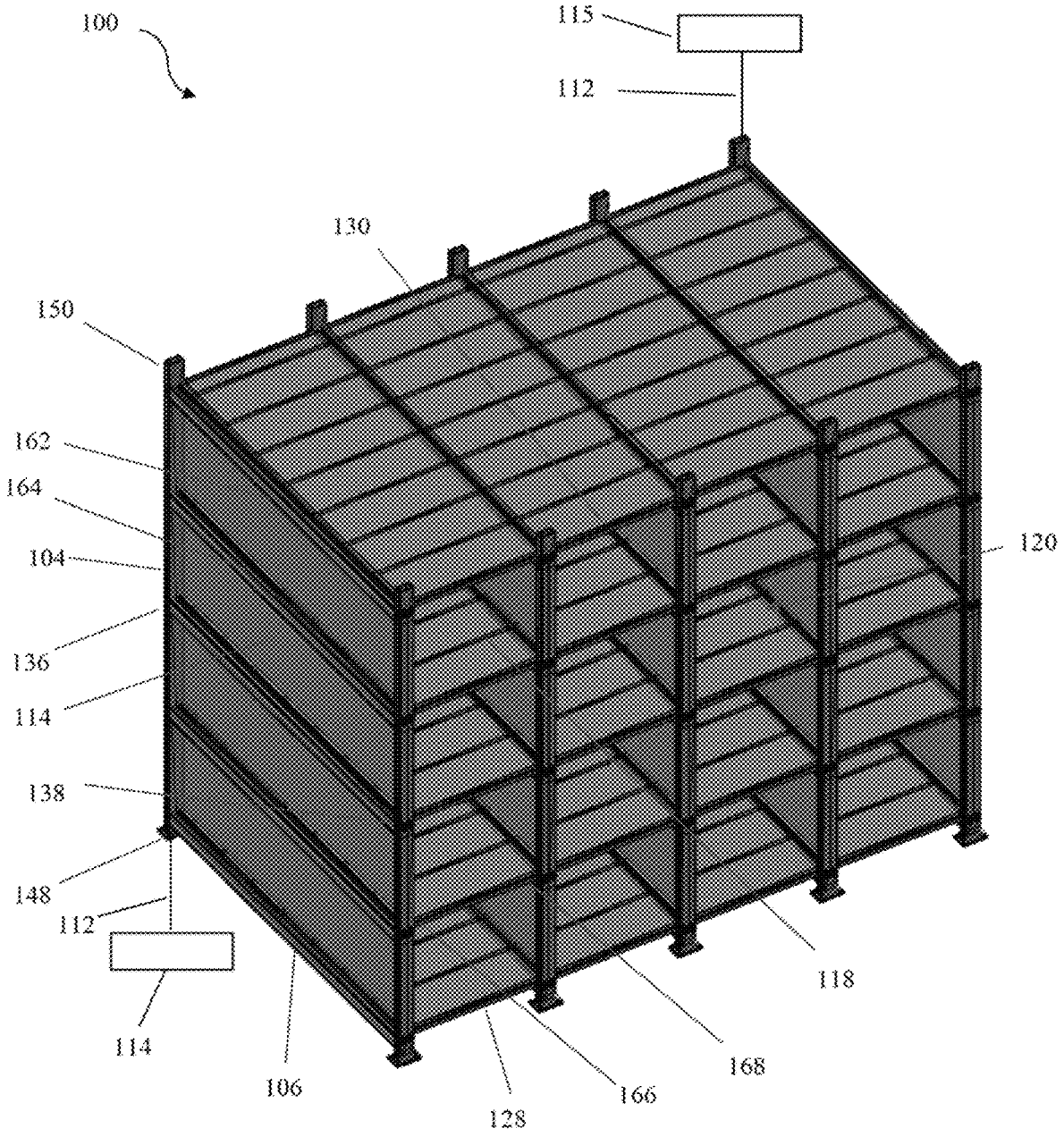
FIG. 1 shows an exemplary crypt system.
Figure 2:
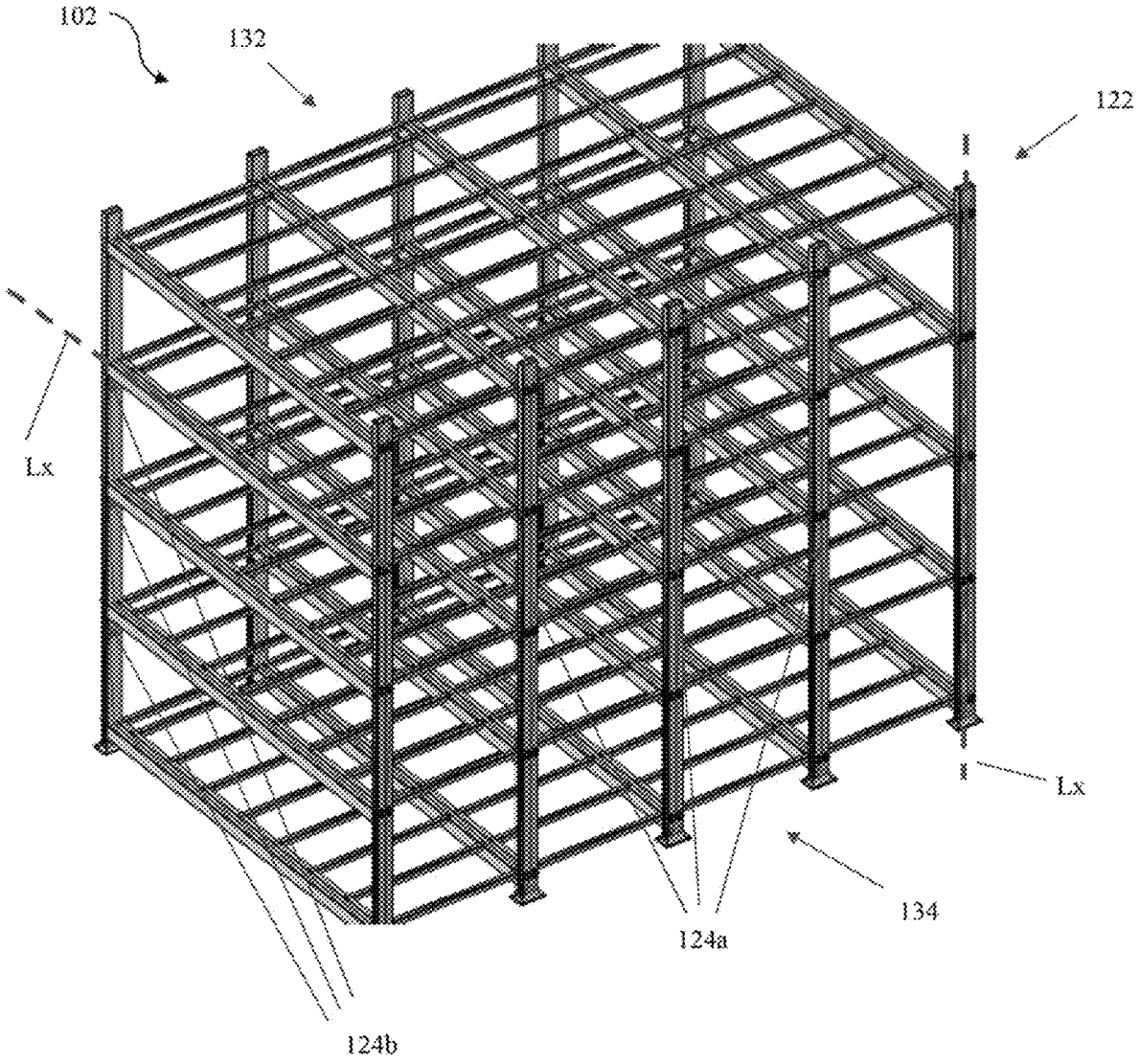
FIG. 2 shows an exemplary frame for a crypt system.
Figure 3:
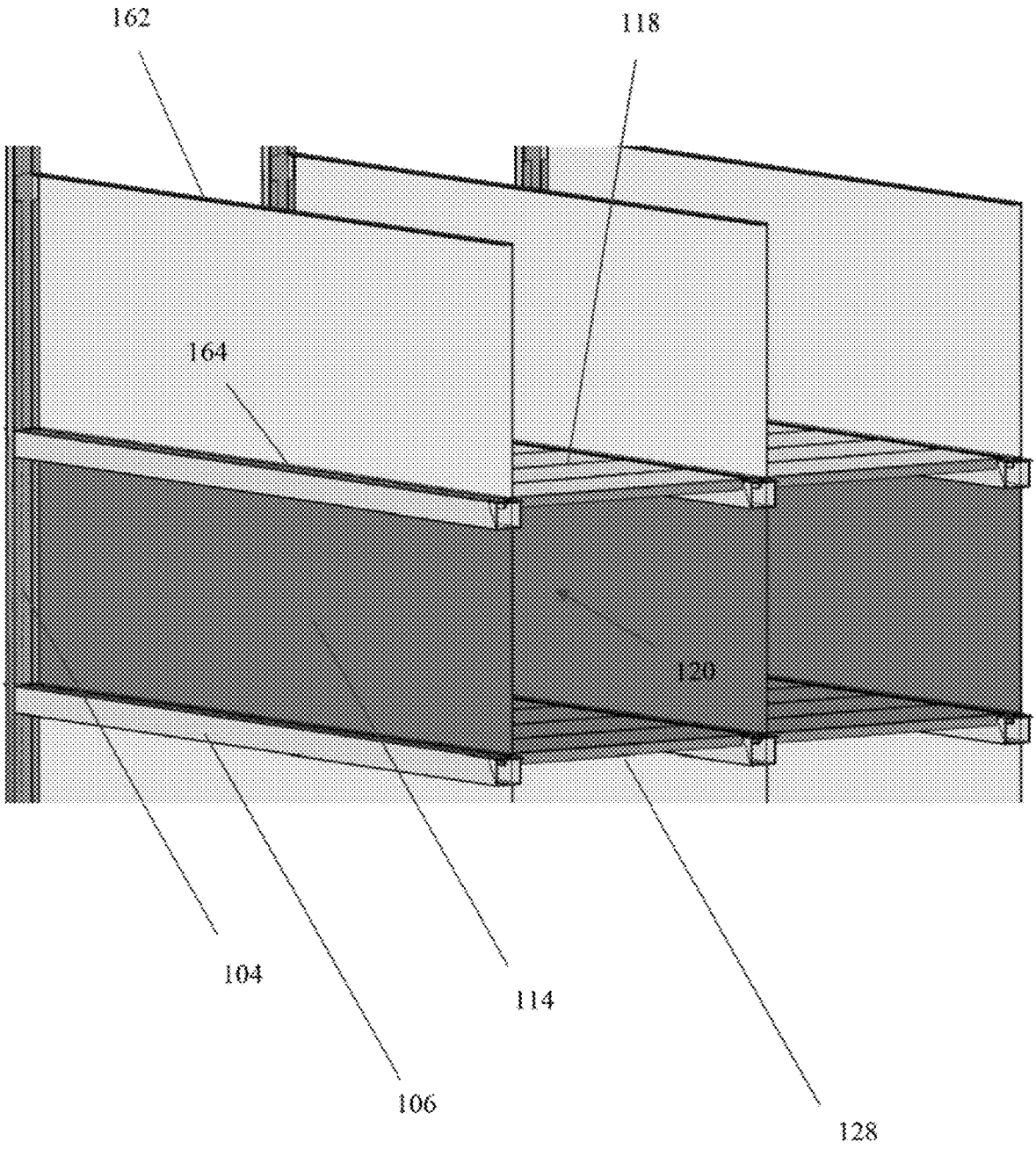
FIG. 3 is a partial view of an exemplary frame showing floor panels and wall panels forming crypt spaces.

Referring to FIGS. 1-3, embodiments relate to a crypt system 100 having a frame 102 used as a skeleton structure upon which a façade (e.g., stone, marble, etc.) is secured. The frame 102 includes vertical supports 104 and horizontal supports 106. Each of the vertical supports 104 and the horizontal supports 106 is equipped with a mechanical interconnecting arrangement that allows the frame 102 to be assembled easily and with close tolerances. The interconnecting arrangement also provides the structural stability and integrity desired for a mausoleum or columbarium, even when the system is free-standing. It is contemplated for sections of the frame 102 to be fabricated and assembled in an assembly or manufacturing shop. The sections can then be transported to the site for assembly into the frame 102 or skeleton structure. Fabricating and assembling the sections in the shop (as opposed to doing so on-site) allows for the closer tolerances when forming the frame 102. Each horizontal support 106 has a horizontal support fluid channel 108 that collects fluid (e.g., gas and/or liquid) and directs it to the vertical support 104 in connection with the horizontal support 106. Each vertical support 104 has a vertical support fluid channel 110 to direct the gas up to a conduit 112 that leads to outside the building that houses the crypt system 100. The vertical support fluid channel 110 also directs liquid down to a drain 114 that captures the liquid. It is contemplated for the frame 102 to be made from a stainless steel; however, other similar structural materials can be used (e.g., other steels, aluminum, composite material, etc.). It is further contemplated for each piece of the frame 102 to be fabricated from the same material, but dissimilar materials can be used. Fabricating each piece of the frame 102 from stainless steel prevents corrosion from the fluid and avoids corrosion from dissimilar metal contact.

The frame 102 includes a plurality of vertical supports 104 and a plurality of horizontal supports 106. The vertical supports 104 form the up-rights or columns for the frame 102, and the horizontal supports 106 form the cross-beams for the frame 102. When the frame 102 is assembled, each vertical support 104 is supported in an up-right orientation (e.g., perpendicular to the ground surface). When the frame 102 is assembled, each vertical support 104 has a plurality of horizontal supports 106 extending therefrom. For instance, a vertical support 104 has a plurality of horizontal supports 106 extending therefrom at a perpendicular angle from the vertical support 104. Wall panels 116 and floor panels 118 are attached to the vertical supports 104 and horizontal supports 106 so as to form crypt spaces 120. The wall panels 116 and floor panels 118 can be made from the same material as that of the vertical and horizontal supports 106, which preferably is stainless steel.

In an exemplary embodiment, the crypt system 100 has a plurality of vertical supports 104, wherein each vertical support 104 has a plurality of horizontal supports 106 extending therefrom to form the frame 102. In a cubic shaped crypt system 100, for example, the vertical supports 104 are positioned at the corners 122 as well as at interstitial location(s) 124*a* along the front side 134 and rear side 132 of the frame 102 so as to serve as the columns for the frame 102. The horizontal supports 106 extend from the rear side 132 to the front side 134, The horizontal supports 106 extend from each vertical support 104 at a first vertical support end 148 (e.g., a bottom location), a second vertical support end 150 (e.g., a top location), and at interstitial location(s) 124*b*. The volume of space between the horizontal supports and the vertical supports 104 form a plurality of crypt spaces 120. Wall panels 116 and floor panels 118 are used to enclose each crypt space 120, expect at the front side 134. The front side 134 of each crypt space 120 is left open to allow for ingress and egress of remains. For instance, remains can be slid into and out from the crypt space 120 via the front side 134 of each crypt space 120. After the remains are placed within the crypt space 120, a cover (stone or marble slab, a façade, etc.) is secured thereto so close off and seal the crypt space 120.

Along the front side 134 and rear side 132 there are two floor support beams 128 (or a pair of floor support beans 128) spanning between each vertical support 104. Each pair of floor support beams 128 extend from the bottom locations 148 and from the interstitial location(s) 124*b* of the vertical supports 104. Also along the front side 134 and rear side 132 there are cross-beams 130 spanning between each vertical support 104, extending from the top locations 150 of the vertical supports 104.

It is understood that while the description above discusses having a floor support beam 128 (or cross-beam 130 depending on the tier) at the rear side 132 of each crypt space 120 and a floor support beam 128 (or cross-beam 130) at the front side 134 of each crypt space 120, more floor support beams 128 or cross-beams 130 can be used for each crypt space 120. For instance, additional floor support beams 128 can be secured between the horizontal supports 106 so as to provide more structural support for the floor panel 118 of a given crypt space 120, and therefore more structural support for the contents being placed within the crypt space 120.

Each wall panel 116 can be a planar sheet (e.g., rectangular, square, etc.) A wall panel 116 is attached to the frame 102 so that it is vertically oriented (e.g., parallel with the vertical supports 104) and placed within the vertical distance spanning two horizontal supports 106 of a vertical support 104. Wall panels 116 can be similarly installed at other locations, which will depend on the number of crypt spaces 120 formed by the frame 102. Any number of wall panels 116 can be used.

Each floor panel 118 can be a planar sheet (e.g., rectangular, square, etc.) A floor panel 118 is attached to the frame 102 so that it is horizontally oriented (e.g., parallel with the horizontal supports 106, the floor support beams 128, and/or cross-beams 130) and placed within the horizontal distance spanning two horizontal supports 106 and two floor support beams 128 (or cross-beams 130 depending on which tier the floor panel 118 is located). Floor panels 118 can be similarly installed at other locations, which will depend on the number of crypt spaces 120 formed by the frame 102. Any number of floor panels 118 can be used.

As will be explained later, any one or combination of the horizontal supports 106 has a horizontal support fluid channel 108 to capture fluid and direct it to the vertical support fluid channel 110. The remains in the crypt spaces 120 generate gases and fluids, so it is desired to have these directed to a designated space as opposed to staying in the crypt space 120 or leaking out into the building housing the crypt system 100. If gases remain in the crypt space 120 or leak out, this can cause an unpleasant smell for those visiting loved ones. If liquids remain in the crypt space 120, this can cause damage to the crypt system 100. If liquids leak out, they can stain the façade of the crypt system 100. While the horizontal supports 106 extend perpendicularly from its respective vertical support 104, the angle should be slightly off from a true perpendicular angle so as to allow any fluids captured by the horizontal support fluid channel 108 to flow towards the vertical support 104 and thus into the vertical support fluid channel 110. Therefore, any one or combination of the horizontal support 106 of a crypt space 120 extends from its respective vertical support 104 at an angle that is close to but not exactly perpendicular to the vertical support 104—e.g., the horizontal support 106 can form a 85°-89° angle with respect to the vertical support 104 to which it is attached (or the horizontal support 106 form a 1°-5° angle with respect to the ground surface).

In an exemplary embodiment, each horizontal support 106 extending from a vertical support 104 can form a slightly off perpendicular angle with respect to the first vertical support 104 so that any fluid generated in the crypt spaces 120 flows over the floor panels 118, into the horizontal support fluid channels 108, and into the vertical support 104. The vertical fluid channels 110 of the vertical supports 104 are in fluid communication with the horizontal support fluid channels 108 of their respective horizontal supports 106. The bottom portion of the vertical support 104 can be connected to a conduit 112 that leads to a drain 114, catch basin, bladder, reservoir, etc. The drain 114 can be a French drain formed in the ground, for example. Any liquid that enters the vertical support 104 is directed to the conduit 112 and then the drain 114. The top portion of the vertical support 104 can be connected to a conduit 112 that leads to a ventilation system 115 (e.g., air vent, fan, etc.) that expels the gas outside the building that houses the crypt system 100. Any gas that enters the vertical support 104 is directed to the conduit 112 and then to the ventilation system 115. It should be noted that the description of the fluid being directed to one vertical support 104 is exemplary. The frame 102 can be configured such that any one, or combination, of the vertical supports 104 of the frame 102 received fluid and directs the fluid to a drain 114 or a ventilation system 115.

As noted above, it is contemplated for sections of the frame 102 to be fabricated and assembled in an assembly or manufacturing shop. The sections can then be transported to the site for assembly into the frame 102 or skeleton structure. For instance, any number or configurations of vertical supports 104, horizontal supports 106, floor support beams 128, cross-beams 128, wall panels 116, floor panels 118, etc. can be assembled to form a section(s). The section(s) made in the assembly shop. Each section can be transported to the site for assembly into the frame 102.

Figure 4:
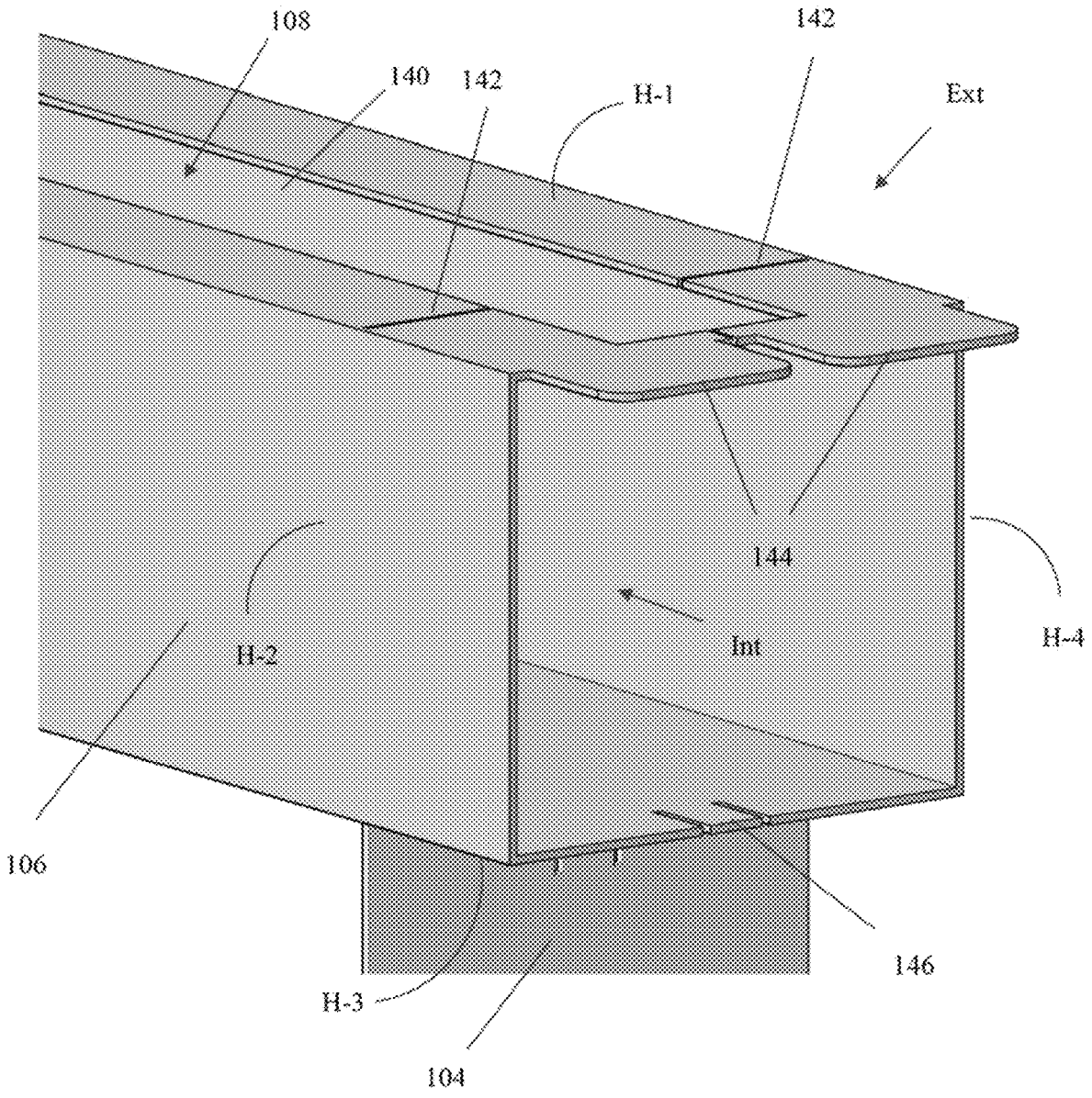
FIG. 4 shows a distal end of a horizontal support.
Figure 5:
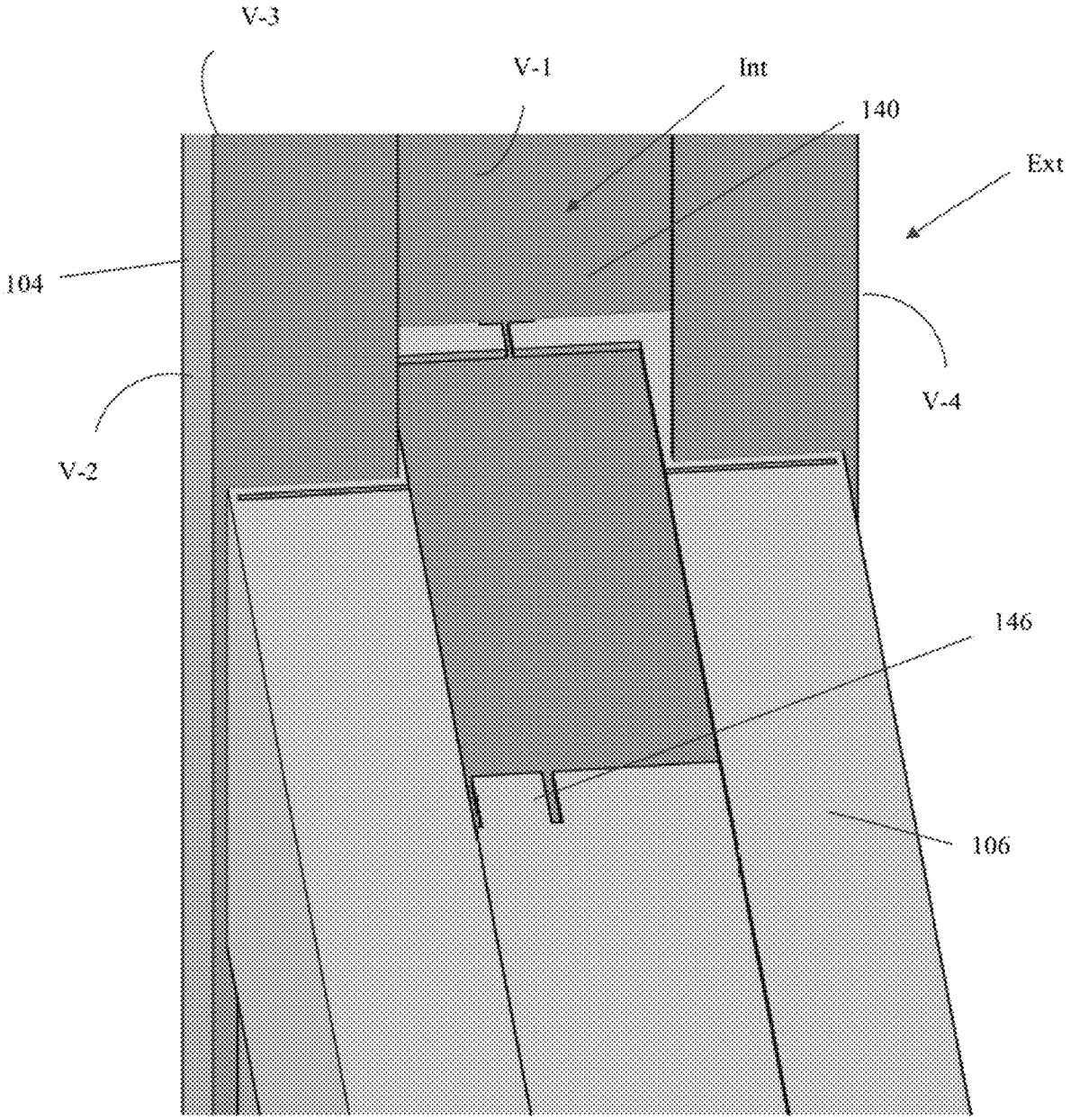
FIGS. 5-9 show various views of an interconnection between a horizontal support and a vertical support.
Figure 6:
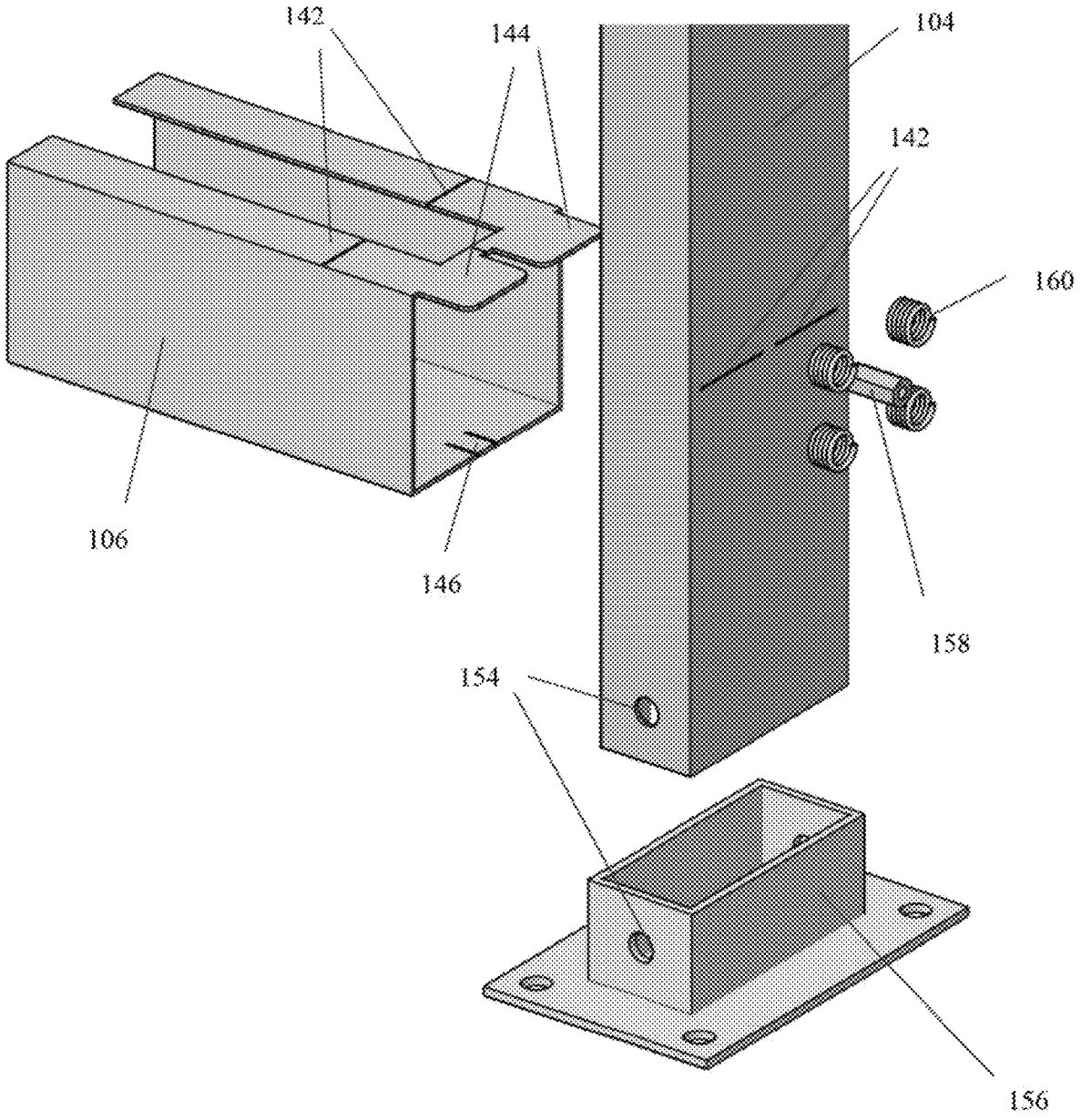
Figure 7:
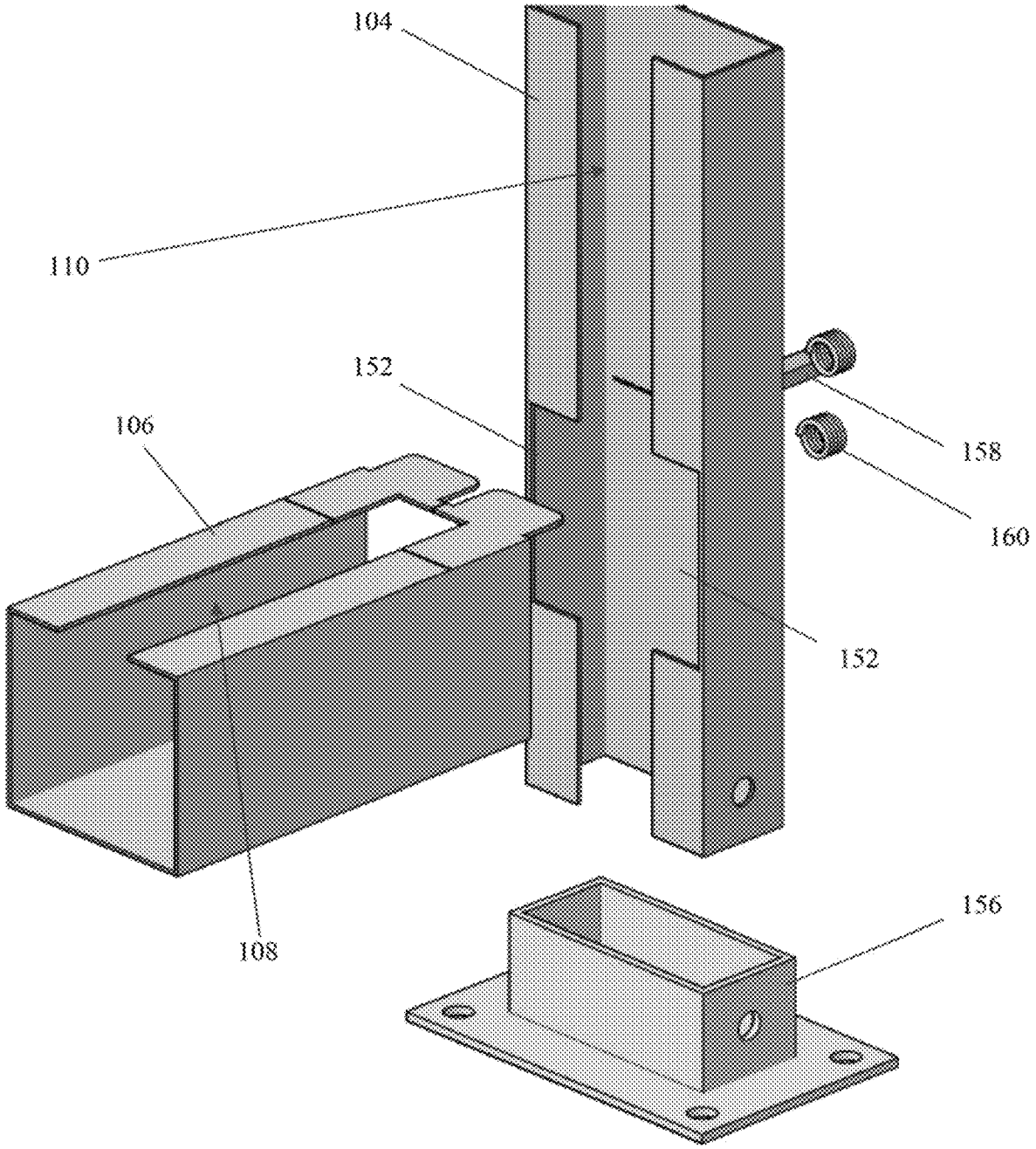
Figure 8:
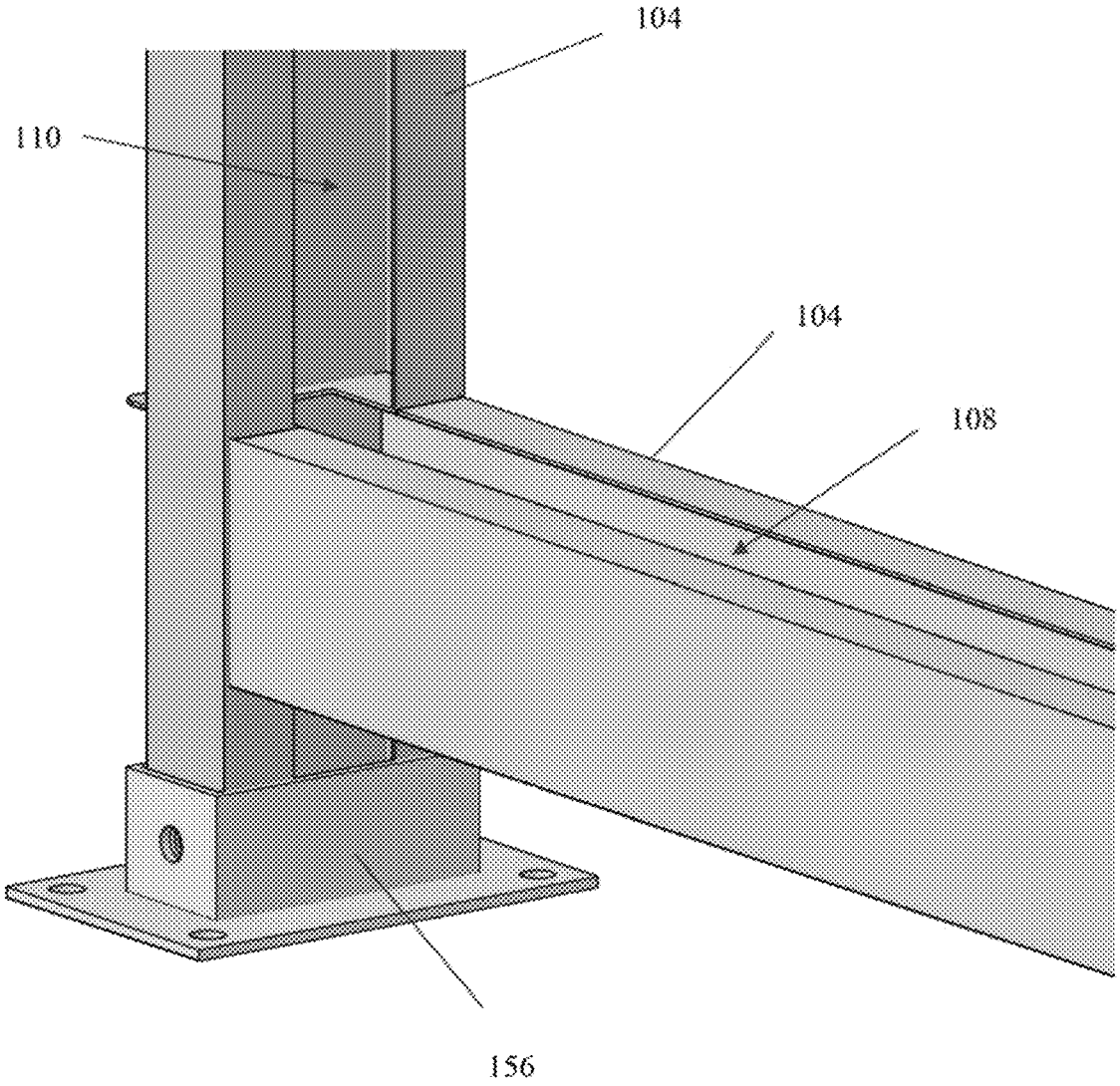
Figure 9:
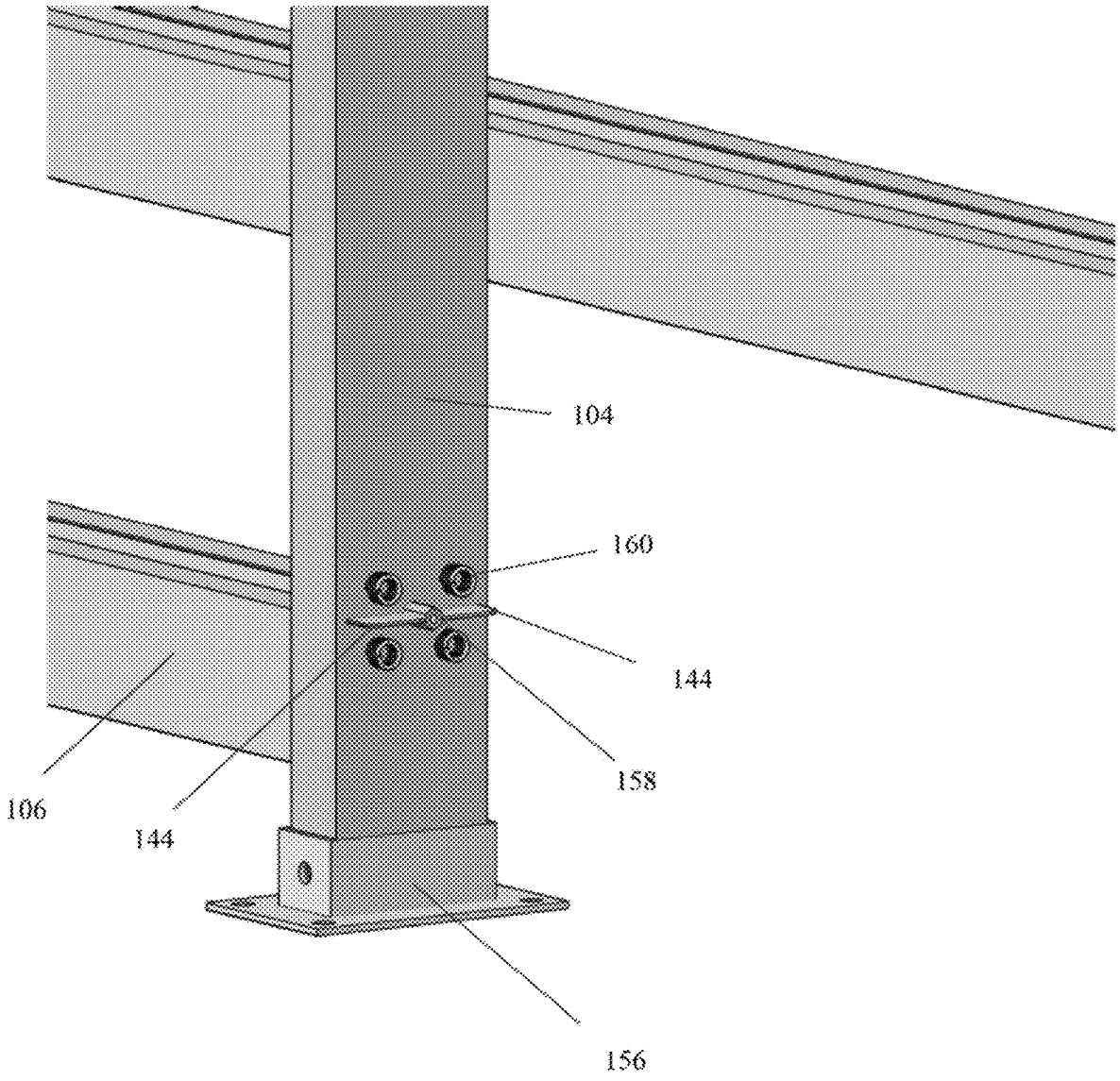

Referring to FIG. 4, each horizontal support 106 is a square tube beam or a rectangular tube beam having a longitudinal axis Lx, a first horizontal support end 136, a second horizontal support end 138, an interior surface Int, and an exterior surface Ext. The exterior surface Ext includes a first side H-1, a second side H-2, a third side H-3, and a fourth side H-4. A slot 140 is formed in the first side H-1 of the horizontal support 106 that runs along the longitudinal axis Lx from the first horizontal support end 136 to the second horizontal support end 138. The slot 140 grants access to the interior surface Int. The slot/interior surface arrangement is the horizontal support fluid channel 108. The fluid that is generated enters the interior surface Int via the slot 140 and is directed to a vertical support fluid channel 110 via gravity due to the slightly-off perpendicular angle the horizontal support 106 makes with the vertical support 104. The horizontal support 106 has two slits 142 formed on the first side H-1 near the first horizontal support end 136, and two slits 142 formed on the first side H-1 near the second horizontal support end 138. The slits 142 are used to receive a portion of the vertical support 104 when the frame 102 is assembled. The horizontal support 106 has two prongs 144 on the first side H-1 that extend out from the first horizontal support end 136, and two prongs 144 on the first side H-1 that extend out from the second horizontal support end 138. The prongs 144 are used to insert through slit pairs 142 of the vertical support 104 when the frame 102 is assembled. The horizontal support 106 has a flap 146 formed in the third side H-3 located at the first horizontal support end 136 and the second horizontal support end 138. The flap 146 is a tab cut-out formed into the third side H-3. The flap 146 is deformable or bendable and can be bent to create an opening through which fluid can flow. It is contemplated for the flap 146 to be bent to create the opening after the frame 102 is constructed but before the wall panels 116 and floor panels 118 are installed.

Referring to FIGS. 5-9, each vertical support 104 is a square tube beam or a rectangular tube beam having a longitudinal axis Lx, a first vertical support end 148, a second vertical support end 150, an interior surface Int, and an exterior surface Ext. The exterior surface Ext includes a first side V-1, a second side V-2, a third side V-3, and a fourth side V-4. A slot 140 is formed in the first side V-1 of the vertical support 104 that runs along the longitudinal axis Lx from the first vertical support end 148 to the second vertical support end 150. The slot 140 grants access to the interior surface Int. The slot/interior surface arrangement is the vertical support fluid channel 110. The fluid that is directed to the vertical support 104 via the horizontal supports 106 enters the interior surface Int of the vertical support 104 via the slot 140 and is directed to conduit 112 that leads to a drain 114 and/or a ventilation system 115. The vertical support 104 has at least one pair of slits 142 formed on the third side V-3 to slidably receive the prongs 144 of a horizontal support 106. For instance, is the frame 102 is configured to have three horizontal supports 106 extending from the vertical support 104 then the vertical support 104 would have three pairs of slits 142. The vertical support 104 also has cut-outs 152 formed on the first side V-1 that correspond with each slit pair. During assembly, the horizontal support 106 is advanced towards the vertical support first side V-1 so that the horizontal support end is received within the cut-outs 152 (a portion of the cut-out 152 entering into the slit 142 of the horizontal support 106) and the prongs 144 insert through the slit pairs 142. The prong 144 then extend through the vertical support 104 and out from the vertical support third side V-3, while the flap 146 remains within the vertical support fluid channel 110. At this point, the flap 146 can be bent to create the opening.

The first vertical support end 148 includes bolt holes 154 that correspond with bolt holes 154 of a truing saddle 156. The truing saddle 156 can be a T-shaped shoe that provides support and stability for allowing the vertical support 104 to stand up-right. The truing saddle 156 is placed on the ground suffice so that the vertical support 104 is inserted therein by inserting the first vertical support end 148 into the truing saddle 156. The truing saddle 156 keeps the vertical support standing up-right and provided stability due to the wide flanged bottom of the truing saddle 156. Bolts can be used to secure the vertical support 104 to the truing saddle 156. Bolts can also be used to secure the truing saddle 156 to the ground surface.

The truing saddle 156 is a hollow structure so that the vertical support fluid channel 110 can be placed into fluid communication with conduit 112 that leads to a drain 114. The truing saddle 156 is a base that levels the entire unit, as well as the anchoring attachment to a floor (e.g., concrete foundation). The second vertical support end 150 is also placed into fluid communication with conduit 112 that leads to a ventilation system 115.

A coupler nut 158 and springs 160 can be welded to the vertical support third side V-3 at locations where the prongs 144 extend through the third side V-3 of the vertical support 104. The extending prongs 144, the coupler nut 158, and the springs 160 are used to support the stone or marble façade. After the frame 102 is constructed, the façade is then attached to the frame 102 by individual stone or marble slabs being supported by the prongs 144, springs 160, and coupler nuts 158.

Each wall panel 116 is a planar sheet having a top end 162 and a bottom end 164. Each top end 162 has an L shape, and each bottom end 164 has a dog-leg shape. The shape of the top end 162 allows the wall panel 116 to abut against the third side H-3 of the horizontal support 106 positioned above it in a flush manner. The dog-leg shape of the bottom end 164 allows the wall panel 116 to rest on the first side H-1 of a horizontal support 106 positioned below it and partially extend into the horizontal support fluid channel 108 through the slot 140 of the horizontal support 106. For instance, the dog-leg shape includes a vertical portion that is the main body of the wall panel 116, a 90° horizontal extension that rests flush with the first side H-1 of the horizontal support 106, and then a 90° vertical extension that extends into the horizontal support fluid channel 108 via the slot 140.

The floor panels 118 are planar sheets that are placed on top of the horizontal supports 106 and secured in place.

Figure 10:
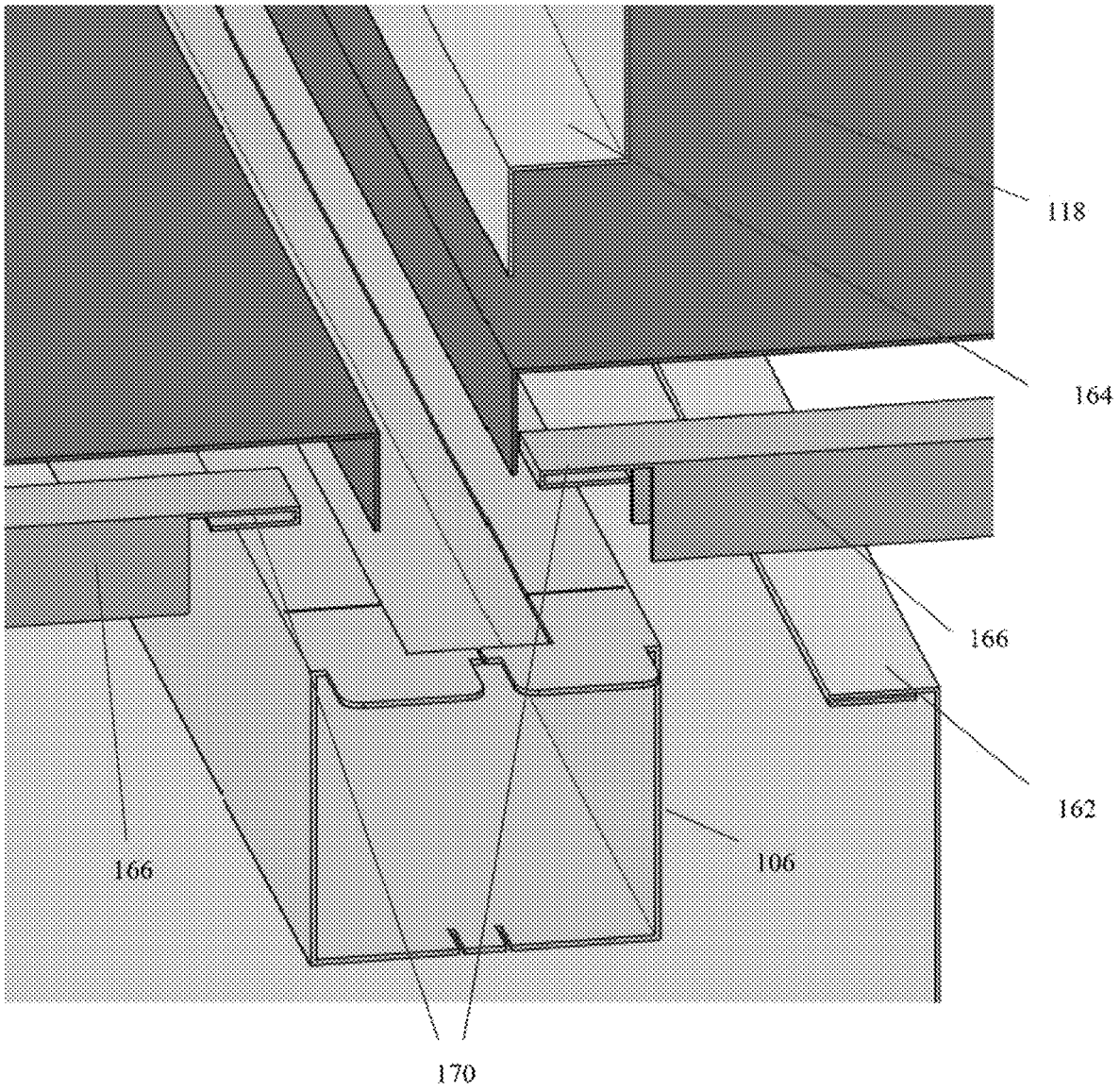
FIGS. 10-11 show various views of an interconnection between a horizontal support and two floor support beams.
Figure 11:
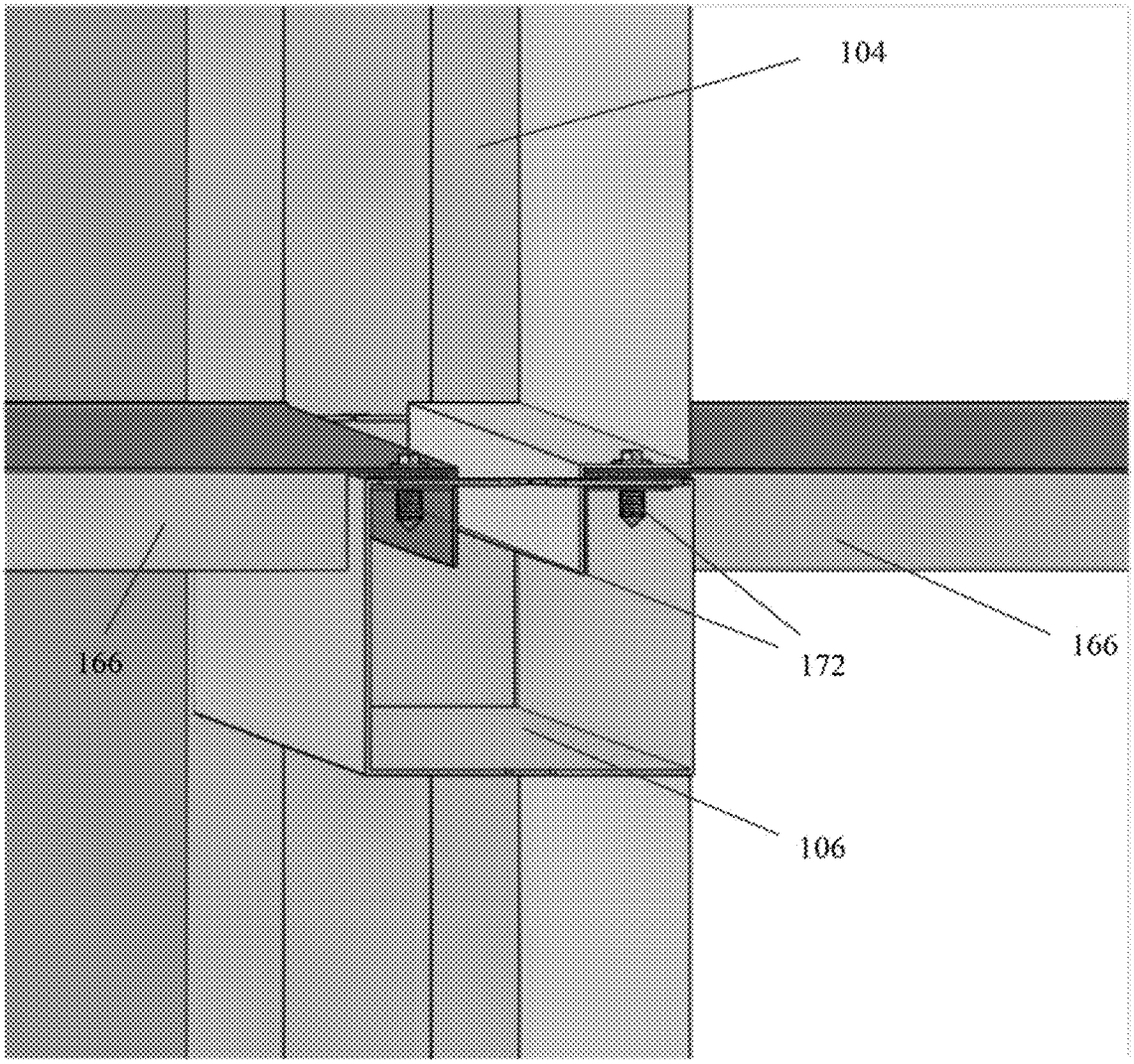

Referring to FIGS. 10-11, the floor support beam 128 is an elongated bar configured to span the length between the vertical supports 104 of the front side 134. Additional floor support beam 128 also spans the length between the vertical supports 104 of the rear side 132. The bar can be a solid structure, a U-shaped channel structure, etc. It is contemplated for the bar to be formed as a U-shaped channel to provide a beam that is lighter in weight than a solid bar but also has the structural integrity desired for construction of the frame 102. Each floor support beam 128 has a floor support beam first end 166 with a J-shaped interconnect 170, and a floor support beam second end 168 with a J-shaped interconnect 170. The J-shaped interconnect 170 extends from the distal end of the floor support beam 128 in a cantilever manner. During assembly of the frame 102, the floor support beam 128 is abutted against the horizontal support 106 so that the J-shaped interconnect 170 rests on top of the first side H-1 of the horizontal support and also extends into the horizontal support fluid channel 108. For instance, the distal end of the floor support beam 128 abuts the second side H-2 of the horizontal support 106 so as to be flush therewith. The J-shaped interconnect 170 has a long extension portion that rests on top of the first side H-1 of the horizontal support 106 so as to be flush therewith. The J-shaped interconnect 170 has a 90° downward extension and another 90° horizontal extension, these two extensions cuffing the edge of the horizontal support fluid channel 108. Thus, the long extension portion rests on the exterior surface Ext of the first side H-1 of the horizontal support 106, the 90° downward extension rests against the edge of the horizontal support fluid channel 108, and the 90° horizontal extension rests against the interior surface Int of the first side H-1 of the horizontal support 106.

Similarly, the distal end of another floor support beam 128 abuts the fourth side H-4 of the horizontal support 106 so as to be flush therewith. The J-shaped interconnect 170 has a long extension portion that rests on top of the first side H-1 of the horizontal support 106 so as to be flush therewith. The J-shaped interconnect 170 has a 90° downward extension and another 90° horizontal extension, these two extensions cuffing the edge of the horizontal support fluid channel 108. Thus, the long extension portion rests on the exterior surface Ext of the first side H-1 of the horizontal support 106, the 90° downward extension rests against the edge of the horizontal support fluid channel 108, and the 90° horizontal extension rests against the interior surface Int of the first side H-1 of the horizontal support 106.

In the exemplary embodiment shown in FIGS. 10-11, a portion of the 90° horizontal extension of the wall panel 116 rests on top of the long extension of the J-shaped interconnect 170 of the floor support beam 128 connected to the second side H-2 of the horizontal support 106. A fastener 172 (e.g., a self-tapping screw) is used to secure the wall panel 116, floor support beam 128, and horizontal support 106 at the J-shaped interconnect 170. A portion of the floor panel 118 rests on top of the long extension of the J-shaped interconnect 170 of the floor support beam 128 connected to the fourth side H-4 of the horizontal support 106. A fastener 172 (e.g., a self-tapping screw) is used to secure the floor panel 118, floor support beam 128, and horizontal support 106 at the J-shaped interconnect 170.

The cross-beams 130 are used at the top portions 150 of the vertical supports 104 in lieu of floor support beams 128.

It should be understood that modifications to the embodiments disclosed herein can be made to meet a particular set of design criteria. It will be apparent to those skilled in the art that numerous modifications and variations of the described examples and embodiments are possible in light of the above teachings of the disclosure. The disclosed examples and embodiments are presented for purposes of illustration only. Other alternative embodiments may include some or all of the features of the various embodiments disclosed herein. For instance, it is contemplated that a particular feature described, either individually or as part of an embodiment, can be combined with other individually described features, or parts of other embodiments. The elements and acts of the various embodiments described herein can therefore be combined to provide further embodiments.

Therefore, it is the intent to cover all such modifications and alternative embodiments as may come within the true scope of this invention, which is to be given the full breadth thereof. Additionally, the disclosure of a range of values is a disclosure of every numerical value within that range, including the end points. Thus, while certain exemplary embodiments of systems and methods of making and using the same have been discussed and illustrated herein, it is to be distinctly understood that the invention is not limited thereto but may be otherwise variously embodied and practiced within the scope of the following claims.

What is claimed is:

1. A crypt system framework, comprising:

a frame comprising a plurality of vertical supports and a plurality of horizontal supports arranged to generate a plurality of crypt spaces;

at least one horizontal support having a horizontal support fluid channel;

at least one vertical support having a vertical support fluid channel; and the at least one horizontal support being connected to the at least one vertical support so that the horizontal support fluid channel is in fluid communication with the vertical support fluid channel, wherein the frame comprises an interconnecting arrangement for attaching the at least one horizontal support to the at least one vertical support, the interconnecting arrangement including prongs of the at least one horizontal support extending through slits formed in the at least one vertical support.

2. The crypt system framework of claim 1, wherein the frame consists of stainless steel.

3. The crypt system framework of claim 1, further comprising:

a plurality of truing saddles, each truing saddle connected to an individual vertical support to hold the vertical support in an erect and up-right orientation.

4. The crypt system framework of claim 1, wherein:

the at least one horizontal support is connected to the at least one vertical support so that the at least one horizontal support extends from the at least one vertical support so as to form a 85o-89o angle with respect to the at least one vertical support.

5. A crypt system framework, comprising:

a frame comprising a plurality of vertical supports and a plurality of horizontal supports arranged to generate a plurality of crypt spaces;

at least one horizontal support having a horizontal support fluid channel;

at least one vertical support having a vertical support fluid channel; and the at least one horizontal support being connected to the at least one vertical support so that the horizontal support fluid channel is in fluid communication with the vertical support fluid channel, wherein each vertical support is a square tube beam or a rectangular tube beam having a longitudinal axis, a first vertical support end, a second vertical support end, an interior surface, an exterior surface, and a slot is formed in a side of the vertical support that runs along the longitudinal axis from the first vertical support end to the second vertical support end; and wherein each horizontal support is a square tube beam or a rectangular tube beam having a longitudinal axis, a first horizontal support end, a second horizontal support end, an interior surface, an exterior surface, and a slot is formed in a side of the horizontal support that runs along the longitudinal axis from the first horizontal support end to the second horizontal support end.

6. The crypt system framework of claim 5, wherein:

the first vertical support end of each vertical support is placed into fluid communication with a conduit that leads to a drain; and the second vertical support end of each vertical support is placed into fluid communication with a conduit that leads to a ventilation system.

7. The crypt system framework of claim 5, comprising:

a flap formed in a side of the horizontal support that is opposite the slot, the flap being deformable or bendable to create an opening that leads into the vertical support fluid channel.

8. A crypt system framework, comprising:

a frame comprising a plurality of vertical supports and a plurality of horizontal supports arranged to generate a plurality of crypt spaces;

at least one horizontal support having a horizontal support fluid channel;

at least one vertical support having a vertical support fluid channel; and the at least one horizontal support being connected to the at least one vertical support so that the horizontal support fluid channel is in fluid communication with the vertical support fluid channel, wherein each horizontal support is a square tube beam or a rectangular tube beam having a longitudinal axis, a first horizontal support end, a second horizontal support end, an interior surface, and an exterior surface, wherein the exterior surface includes a first side, a second side, a third side, and a fourth side, wherein a slot is formed in the first side of the horizontal support that runs along the longitudinal axis from the first horizontal support end to the second horizontal support end; and wherein each vertical support is a square tube beam or a rectangular tube beam having a longitudinal axis, a first vertical support end, a second vertical support end, an interior surface, and an exterior surface, wherein the exterior surface includes a first side, a second side, a third side, and a fourth side, wherein a slot is formed in the first side of the vertical support that runs along the longitudinal axis from the first vertical support end to the second vertical support end.

9. The crypt system framework of claim 8, further comprising:

a plurality of floor support beams, wherein each floor support beam is a U-shaped channel structure with a floor support beam first end having a J-shaped interconnect that extends from the first end of the floor support beam in a cantilever manner, and a floor support beam second end having a J-shaped interconnect that extends from the second end of the floor support beam in a cantilever manner.

10. The crypt system framework of claim 9, wherein:

each floor support beam is abutted against a horizontal support so that the J-shaped interconnect rests on top of the first side of the horizontal support and also extends into the horizontal support fluid channel.

11. A crypt system, comprising:

a frame, comprising:

a plurality of vertical supports and a plurality of horizontal supports, wherein:

each vertical support is a square tube beam or a rectangular tube beam having a longitudinal axis, a first vertical support end, a second vertical support end, an interior surface, an exterior surface, and a slot is formed in a side of the vertical support that runs along the longitudinal axis from the first vertical support end to the second vertical support end, wherein the interior surface forms a vertical support fluid channel;

each horizontal support is a square tube beam or a rectangular tube beam having a longitudinal axis, a first horizontal support end, a second horizontal support end, an interior surface, an exterior surface, and a slot is formed in a side of the horizontal support that runs along the longitudinal axis from the first horizontal support end to the second horizontal support end, wherein the interior surface forms a horizontal support fluid channel;

each vertical support has a plurality of horizontal supports connected thereto so that the horizontal support fluid channel of each is in fluid communication with the vertical support fluid channel;

wherein the plurality of vertical supports and the plurality of horizontal supports are arranged to generate a plurality of crypt spaces;

a plurality of wall panels, each wall panel forming a sidewall for each crypt space;

a plurality of floor panels, each floor panel forming a floor for each crypt space; and a façade attached to an exterior of the frame.

12. The crypt system of claim 11, wherein the frame, the plurality of wall panels, and the plurality of floor panels consist of stainless steel.

13. The crypt system of claim 11, wherein:

the first vertical support end of each vertical support is placed into fluid communication with a conduit that leads to a drain, and liquid generated within the plurality of crypt spaces is directed through a horizontal support fluid channel to a vertical support fluid channel and to the drain;

the second vertical support end of each vertical support is placed into fluid communication with a conduit that leads to a ventilation system, and gas generated within the plurality of crypt spaces is directed through a horizontal support fluid channel to a vertical support fluid channel and to the ventilation system.

14. The crypt system of claim 13, wherein:

at least one horizontal support is connected to its respective vertical support so that the at least one horizontal support extends from the vertical support so as to form a 85o-89o angle with respect to the vertical support, thereby allowing gravity to force the liquid or gas to travel from the horizontal support fluid channel to the vertical support fluid channel.

15. The crypt system of claim 11, wherein:

each first horizontal support end has two prongs;

each second horizontal support end has two prongs; and each vertical support has a pair of slots configured to receive the two prongs of the first or second horizontal support end.

16. The crypt system of claim 11, wherein each wall panel is a planar sheet having a top end that is L shaped and a bottom end that is dog-leg shaped.

17. The crypt system of claim 16, wherein each wall panel rests upon a horizontal support so that it partially extends into the horizontal fluid channel through the slot of the horizontal support.

* * * * *